United States Patent [19]

Metz

[11] 4,437,853

[45] Mar. 20, 1984

[54] SEAM SEALING DEVICE AND TECHNIQUE

[75] Inventor: Bruce E. Metz, Wilmington, Del.

[73] Assignee: Athena Controls Inc., Plymouth Meeting, Pa.

[21] Appl. No.: 294,336

[22] Filed: Aug. 19, 1981

[51] Int. Cl.[3] ..... B65B 9/08

[52] U.S. Cl. ..... 493/302; 53/551; 156/466

[58] Field of Search ..... 53/550, 551, 552, 451, 53/450; 493/302; 156/555, 583.1, 466; 219/243, 528, 549

[56] References Cited

U.S. PATENT DOCUMENTS

| | | | |
|---|---|---|---|
| 2,899,875 | 8/1959 | Leasure | 493/302 X |
| 2,979,114 | 4/1961 | Milne | 493/302 X |
| 3,569,665 | 3/1971 | Hager, Jr. | 219/243 X |
| 3,575,769 | 4/1971 | Radzio | 156/466 |
| 3,795,081 | 3/1974 | Brown, Jr. et al. | 53/551 X |
| 4,108,713 | 8/1978 | Weise | 219/243 X |
| 4,274,244 | 6/1981 | Gilbert | 53/551 X |
| 4,293,763 | 10/1981 | McMullan | 219/528 |

*Primary Examiner*—James F. Coan
*Attorney, Agent, or Firm*—William E. Cleaver

[57] ABSTRACT

The present invention includes a heating element which is secured to a rigid member and which is located so that when a plastic like material is being formed into a package or bag, by effecting a seam along the side of the package, the inside of said side seam will be heated, in addition to said outside of said side seam to help provide a better sealed seam.

5 Claims, 5 Drawing Figures

SEAM SEALING DEVICE AND TECHNIQUE

BACKGROUND

For quite some time various foods, such as potato chips, pretzels and the like, have been packaged in flexible plastic packaging materials. Throughout this description when we mention plastics we mean to include foils, or laminated polymers and foils, or in general the materials which are used with form filled seal packaging machines to package potato chips, pretzels, nuts and the like. The general practice is to have a roll of such plastic material loaded onto a holder means and to have the plastic material drawn therefrom. The plastic material is pulled over a series of idlers, passed around a forming collar (or some means to keep the inside of the package open so that the items or food to be held by the plastic bag can be loaded into the bag), pulled through the forming collar, formed into a sealed seam along at least one side, and crimped at the top and bottom. The seam along the side of the package is usually either an overlap seal or a fin seal. The plastic material is usually pulled by crimping jaws which crimp the bottom of one package and the top of the preceding (i.e. preceding through the machine) package at the same time. The crimping jaws are housed in a mechanism which moves toward and away from the forming collar (up and down in the case of a vertical form filled seal packaging machine). There is also included a means for cutting the plastic material between the bottom seam of one package and the top seam of the preceding package.

The side seam is effected by having a heat seal bar located in close proximity to the path of the plastic which has passed through the forming collar. The heat seal bar is ideally as long as the package to be formed. As its name implies, the heat seal bar is a rigid element which is heated by an electrical heating element. As the plastic material leaves the forming collar, the material is dragged between a tongue (a rigid member located inside of the package) and the heat seal bar. The plastic material is heated all along the excursion while it is in contact with the heat seal bar. Ideally the plastic material is heated uniformly to a temperature of about 250° F. to 300° F. (depending on the material) and at this temperature the layers of the plastic material which are disposed in either a fin seal or an overlap seal, are joined together to form a sealed seam.

The foregoing described technique and machines have worked satisfactorily for the most part but with the advent of more stringent packaging demands thicker materials have had to be used, and with increased costs, higher loading speeds (of the items to be packaged) have been attempted. For instance the makers of certain potato chips and corn chips and the like have found if the food inside the plastic package is exposed to ultraviolet light, or himidity, then food spoils and their customers are dissatisfied (or if ill, lawsuits sometimes follow). Accordingly, the food packaging industry has move to a package made up of material comprising a lamination of metal foil, paper and polyolefin webs or combinations of derivatives thereof. This new packaging material is thicker than the plastics used heretofore and this thicker material is more difficult to heat and seal into suitable side sealed seams.

The solution does not lie in increasing the heat because above 330° F. the polyolefins suffer thermal degradation and the package is destroyed. In addition, the new packaging material has become costly and increased speeds for packaging is desirable to offset the increased costs by increased production. It has been found that if the temperatures are held to less than 300° F. to prevent thermal degradation, machine speed is limited by heat transfer rates or there results "skips", which are areas or sections along the seam that come apart. The present invention addresses itself to the problem of improving the side seam seal while maintaining an acceptable temperature and accommodating higher throughput speeds.

SUMMARY

The present invention provides a flexible heating element that can be readily secured to an already present tongue element or a newly designed tongue means. The mounting of the heating element on the tongue means causes the plastic material to be heated from the surface opposite from the surface heated by the heat seal bar. To state it another way, the heat seal bar heats the material from the side which becomes the outside of the package while the present heating element heats the plastic material from the side which becomes the inside of the package. Accordingly, there is a reduced heat gradient loss for the increased thickness of the material, the sealed seam is a well bonded seal and the machine can operate a higher speed.

The objects and features of the present invention will be better understood in view of the description below taken in conjunction with the drawings in which.

Figure 1:
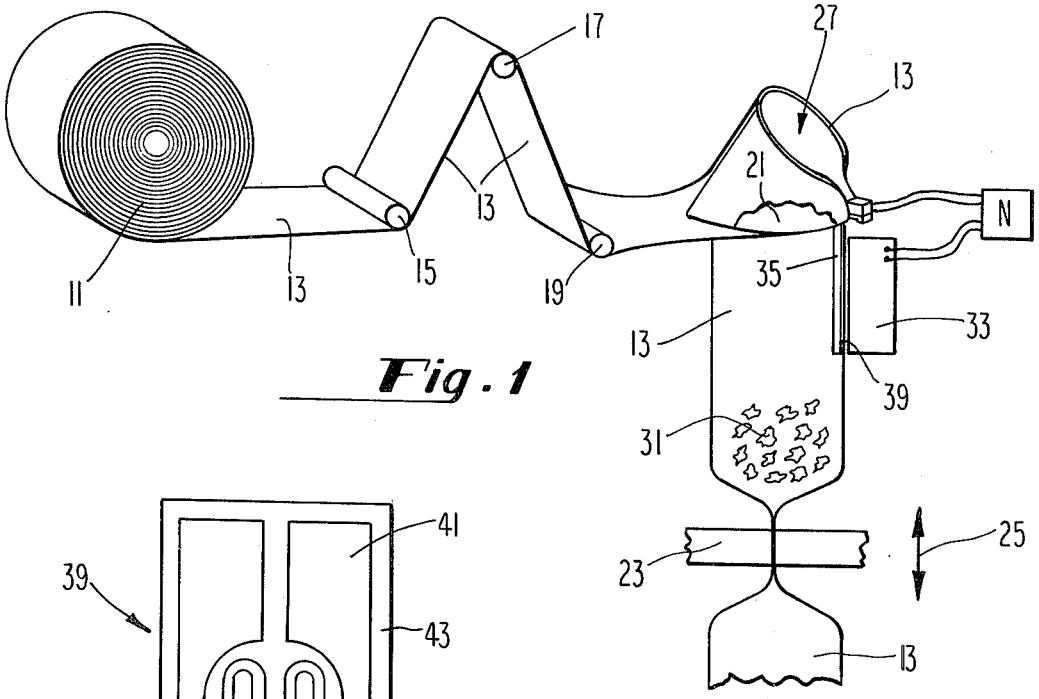
FIG. 1 is a schematic pictorial of a section of a packaging machine showing the plastic material passing through a forming collar and through a side seam sealing station.

Consider FIG. 1 wherein there is shown a roll 11 of plastic material 13. Bear in mind that a reference to plastic material is meant to include: the polymers; or polyolefins; laminated foil and polyolefins; laminated foil, paper and polymers and any combinations thereof. To say it another way "plastic" in this description is meant to include the materials which are formed into bags or packages to hold items, particularly food, and which material is heated to form a seal along at least one side of the package or bag. The plastic material 13 is pulled over the idlers 15, 17 and 19, and up, over and through a forming collar 21. The forming collar is shown in FIG. 1 in the breakaway portion of the plastic material 13. The forming collar is also shown to be seen through the plastic material in FIG. 4, although if the plastic is opaque or laminated the forming collar would not be seen. The plastic material is pulled from the underside of the forming collar by the crimping bars 23. The crimping bars 23 are held by a device which moves up and down as depicted by arrow 25. The plastic material 13 moves around and through the forming collar 21. In particular it passes through the top opening 27 of the forming collar and through the slit 29. In order to provide a better understanding of the overall operation of the machine, it should be understood that at some point in the "pull through" cycle the items, (food and the like), are loaded through the opening 27 into the bag or package. In FIG. 1 food 31 is shown loaded in the bag being formed.

Figure 3:
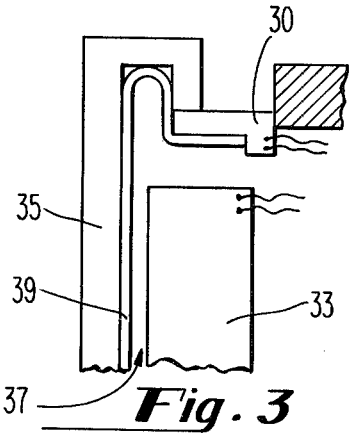
FIG. 3 is a schematic showing the relationship between the heating bar and the heating element on the tongue.

As the plastic material 13 is pulled downward it is dragged through a slit between the heat seal bar 33 and the tongue 35. The slit 37 can be better appreciated in FIG. 3. Bear in mind that the plastic material is overlapped or folded by the shape of the forming collar as it passes into the slit 37. It should be noted that the tongue 35 has a heating element 39 secured thereto. As the plastic material 13 is is dragged through the slit 37 it is in contact with the heat seal bar 33 and the heating element 39. Accordingly the inside of the bag is heated by the heating element 39 while the outside of the bag is heated by the heat seal bar 33. The heat is applied to both the inside of the seam location and the outside of the seam location for the entire excursion of the plastic material 13 through the slit 37. When the plastic material 13 leaves the slit 37 the edge sections of plastic material are sealed onto one another into a well bonded seam. Because the seam is heated on the inside as well as on the outside, thicker bag materials (of the laminated type) can be used and such materials can be run at higher speeds than heretofore, possible, without having the packages subject to "skips". As can be seen in FIG. 1, the heating bar 33 and the heating element 39 are electrically connected to a power source 34.

Figure 2:
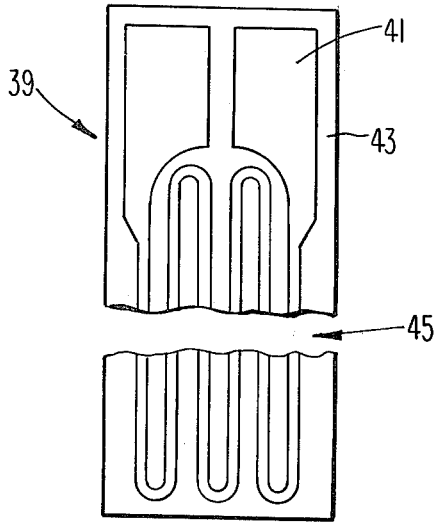
FIG. 2 is a pictorial schematic showing the make up of the flexible heating element.

In FIG. 2 we find the heating element material 41 housed inside of an encasement material 43. In the preferred embodiment the heating element material is made of 70% nickel and 30% iron and can be obtained under the trademark of BALCO, manufactured by the Wilbur Driver Co. a division of Amax Specialty Metals. Other heating element materials can be used if they provide the correct temperature and flexibility.

Figure 5:
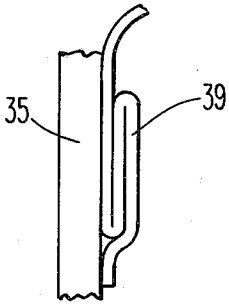
FIG. 5 shows the heating element in a folded configuration.

In the preferred embodiment the encasement material 43 is a polymer manufactured by the Dupont Company with a trademark of KAPTON. Such encasement material is an electrical insulating material and can withstand temperatures up to 800° F. before it becomes damaged. Other encasement materials could be used if they are flexible, electrical insulators and can withstand temperatures up to 500° F. The heating element 39 shown in Figure two is shown with a break 45 therein to indicate that it is much longer than shown. One of the attractive features of this invention is that the heating element can be made in a few lengths to accommodate the many different lengths of tongue members used in the packaging industry. By having a flexible heating element material in a flexible encasement the element can be folded over as shown in FIG. 5. In this way the cost of the element can be reduced since only a few lengths are necessary. The heating element 39 is bonded to the tongue member, in the preferred embodiment, with Kapton base pressure sensitive type bonding material obtained from Oak Materials Group, Inc. This same material is used to bond the folded encasement material onto itself as shown in FIG. 5. It should be understood that other suitable materials can be used. It should also be understood that a folded heating element provides a means for unequal heat distribution or uneven heat supply which can be very useful. For instance, it has been found that since the plastic material which first comes in contact with the heating element is in a "cold" state, that for certain kinds of plastic material it is useful to provide additional heat at the beginning of the path that the plastic material will take in its excursion along the heating element (i.e. along the slit 37). The additional heat enables the seam to be readily and satisfactorily sealed.

Figure 4:
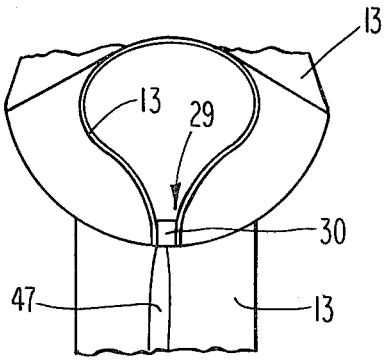
FIG. 4 is a pictorial schematic depicting the relationship of the heated tongue and the forming collar.

In FIG. 4 the relationship of the plastic material 13 and the forming collar 21 is shown to provide a better understanding of how the plastic material 13 as it is pulled through the forming collar 21 overlaps along the seam location 47, to form an overlap section and be sealed by the heat from the heat seal bar 33 and the heating element 39.

I claim:

1. An arrangement for producing a sealed seam of a plastic package, which plastic package is formed in part by pulling at least a portion of a sheet of plastic material, which has first and second edge sections, through a forming means whereby said first edge section is guided to form an overlay section with said second edge section, comprising in combination: heat seal bar means disposed to come in contact, along said overlay section, with the side of the plastic material which becomes the outside of the package as said plastic material moves along said heat bar means, said heat seal bar means formed to generate heat and transfer said heat to said overlay section of said plastic material; tongue element means formed and disposed to form a slit between a first side thereof and said heat seal bar means; and flexible heating means secured to said first side of said tongue element and disposed to come in contact, along said overlay section, with the side of the plastic material which becomes the inside of the package to transfer heat to said overlay section of said plastic material as said plastic material moves within said slit, whereby a seam can be rapidly formed along said overlay section in response to the direct heat transfer from said heat seal bar and to the direct heat transfer from said flexible heating means.

2. An arrangement for producing a sealed seam of a plastic package according to claim 1 wherein said flexible heating means comprises a flexible metallic heating element completely encased in a flexible plastic material.

3. An arrangement for producing a sealed seam of a plastic package according to claim 2 wherein said plastic material suffers thermal degradation at a much lower temperature than does said flexible encasement plastic material.

4. An arrangement for producing a sealed seam of a plastic package, which plastic package is formed in part by pulling at least a portion of a sheet of plastic material, which has first and second edge sections, through a forming means whereby said first edge section is guided to form an overlay section with said second edge section, comprising in combination: heat seal bar means disposed to come in contact, along said overlay section, with the side of the plastic material which becomes the outside of the package as said plastic material moves along said heat bar means, said heat seal bar means formed to generate heat and transfer said heat to said overlay section of said plastic material; tongue element means formed and disposed to form a slit between a first side thereof and said heat seal bar means; and flexible heating means formed to be folded back on itself to provide a greater transfer of heat at a first location then at a second location, said flexible heating means secured to said first side of said tongue element and disposed to come in contact, along said overlay section, with the side of the plastic material which becomes the inside of the package to transfer heat to said overlay section of said plastic material as said plastic material moves within said slit whereby a seam can be rapidly formed along said overlay section in response to the direct heat transfer from said heat seal bar and to the direct heat transfer from said flexible heating means.

5. An arrangement for producing a sealed seam of a plastic package according to claim 4 wherein said first location is where said overlay section first enters said slit in order to provide more heat to cold plastic material.

* * * * *